US006994603B2

(12) United States Patent
Clark et al.

(10) Patent No.: US 6,994,603 B2
(45) Date of Patent: Feb. 7, 2006

(54) INTEGRATED TRANSMISSION BELL HOUSING

(76) Inventors: Tim T. Clark, 4181 NW. 6th St., Deerfield Beach, FL (US) 33442; Harry L. Schoell, 281 SE. 3rd Ct., Pompano Beach, FL (US) 33060

( * ) Notice: Subject to any disclaimer, the term of this patent is extended or adjusted under 35 U.S.C. 154(b) by 16 days.

(21) Appl. No.: 10/775,291

(22) Filed: Feb. 10, 2004
(Under 37 CFR 1.47)

(65) Prior Publication Data

US 2005/0176313 A1 Aug. 11, 2005

Related U.S. Application Data

(60) Provisional application No. 60/540,440, filed on Jan. 30, 2004, provisional application No. 60/542,148, filed on Feb. 6, 2004.

(51) Int. Cl.
*B63H 20/14* (2006.01)
*F16H 57/02* (2006.01)

(52) U.S. Cl. ..... 440/75; 74/606 R

(58) Field of Classification Search ..... 440/75, 440/76, 111; 74/606 R
See application file for complete search history.

(56) References Cited

U.S. PATENT DOCUMENTS

| | | | | |
|---|---|---|---|---|
| 3,263,663 | A * | 8/1966 | Connell | 123/195 R |
| 3,386,242 | A * | 6/1968 | Trapp | 60/791 |
| 4,369,384 | A | 1/1983 | Nardi | |
| 4,666,412 | A | 5/1987 | Rawlings | |
| 5,058,558 | A * | 10/1991 | Ueda et al. | 123/559.1 |
| 5,326,294 | A | 7/1994 | Schoell | |
| 5,462,465 | A | 10/1995 | Schmidt | |
| 5,494,466 | A | 2/1996 | Vernea | |
| 5,530,305 | A | 6/1996 | Krueger et al. | |
| 5,761,959 | A * | 6/1998 | Winter | 74/15.66 |
| 6,095,876 | A | 8/2000 | Ozawa et al. | |
| 6,328,004 | B1 | 12/2001 | Rynhart | |
| 6,357,399 | B1 | 3/2002 | Nakamura | |
| 6,482,057 | B1 | 11/2002 | Schoell | |

* cited by examiner

*Primary Examiner*—Andrew D. Wright
(74) *Attorney, Agent, or Firm*—Robert C. Kain, Jr.; Fleit Kain

(57) ABSTRACT

The integrated bell housing on an engine, carries a supercharger, an alternator, a water pump and a starter. The engine has a crankshaft which is coupled to a flywheel in the casing as is a geared transmission. The flywheel has a first gear and a second gear. The first gear drives a supercharger drive shaft which drives the supercharger. The second gear is coupled to an alternator drive shaft such that the flywheel drives the alternator. A water pump drive shaft is keyed to the crankshaft and is rotatably mounted through the bell housing.

32 Claims, 10 Drawing Sheets

INTEGRATED TRANSMISSION BELL HOUSING

This is a regular patent application based upon and claiming the benefit of provisional patent application Ser. No. 60/540,440 filed Jan. 30, 2004 and provisional patent application Ser. No. 60/542,148 filed Feb. 6, 2004.

The present invention relates to an integrated bell housing, particularly for a marine internal combustion engine, which houses a geared transmission for the engine and which carries certain engine accessories thereon.

Historically, certain engine accessories such as the alternator, supercharger, water pump, are typically located on the front of the internal combustion engine and are driven from the engine with belts and pulleys. Of course, the starter is rear mounted and drives the engine at start-up engaging with the flywheel. In a marine environment, it is beneficial to reduce the overall length of the engine while maintaining the high performance of the marine internal combustion engine. Further, in a marine environment which is subject to the corrosive effect of salt and degradation by water and humidity, belts and pulleys are high maintenance items.

In the past, starters are sometimes coupled to the engine by a gear ring attached on or about the flywheel wherein the flywheel is typically a connection point to the transmission for the internal combustion engine.

OBJECTS OF THE INVENTION

It is an object of the present invention to mount a supercharger (if necessary), alternator and a water pump on the exterior of a bell housing and transmission case and drive those engine accessories from the flywheel (the supercharger and alternator) and from a pump drive shaft keyed to the crankshaft of the engine (the water pump).

It is a further object of the present invention to provide an integrated bell housing wherein the supercharger, alternator, water pump and starter are mounted on the exterior of the bell housing and transmission case. The supercharger may be omitted as appropriate.

It is an additional object of the present invention to provide a marine engine with an integrated bell housing which is generally smaller in length than comparable marine engines due to the repositioning of engine accessories and utilization of the integrated bell housing.

SUMMARY OF THE INVENTION

The integrated bell housing, employed on a marine internal combustion engine, carries on its exterior engine accessories such as a supercharger, an alternator, a water pump and a starter. The engine has a crankshaft attaching flange extending into the interior space of the bell housing to which is coupled the flywheel. The bell housing also encloses a geared transmission which is coupled to the crankshaft via a flex plate. The integrated bell housing includes mounting system for the supercharger, alternator and starter. The water pump is driven from a shaft connecting to the crankshaft through the rear of the transmission case. The flywheel incorporates two gear faces for the purpose of driving engine accessories. A first complementary gear is coupled to a supercharger drive shaft rotatably mounted through the bell housing such that the flywheel drives the supercharger. A second complementary gear is coupled to an alternator drive shaft rotatably mounted through the bell housing such that the flywheel drives the alternator. A water pump drive shaft is keyed to the crankshaft and is rotatably mounted through the transmission housing such that the crankshaft of the engine drives the water pump. The starter is mounted on the bell housing and a starter drive shaft is rotatably mounted through the bell housing such that the starter can be adopted to drive the flywheel to start the engine.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to an integrated transmission bell housing for an internal combustion engine, and particularly for a marine internal combustion engine. In one working embodiment, the integrated bell housing is utilized in conjunction with a GENERAL MOTORS (GM) 60 degree V6 internal combustion engine. Utilizing the integrated bell housing with engine accessories such as a supercharger, alternator, water pump and starter mounted on the bell housing and transmission case, the specially configured marine internal combustion engine provides the following characteristics:

| Specifications: | GENERAL MOTORS 60 degree V6 | | |
|---|---|---|---|
| Horsepower | 300 | 240 | 175 |
| Displacement | 3.4 L | 3.4 L | 3.4 L |
| Cylinders 60 degree V6 | 6 | 6 | 6 |
| Compression Ratio | 9.5:1 | 9.5:1 | 9.5:1 |
| Fuel System | MPI | MPI | MPI |
| Weight - U.S. LBS (including transmission) | 400 | 400 | 390 |
| RPM Full Throttle | 5200 | 5200 | 5200 |

Figure 1:
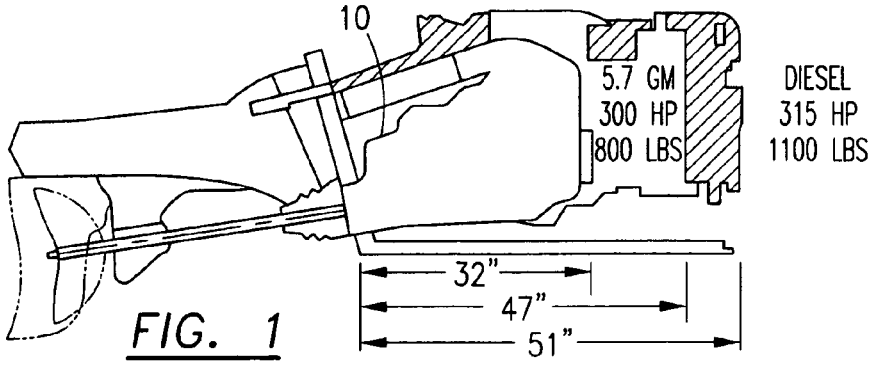
FIG. 1 diagrammatically illustrates the integrated transmission bell housing attached to a marine internal combustion engine and graphically compares the length of the specially configured engine (32 inches) against the length of a comparable GENERAL MOTORS engine (47 inches) and against the length of a diesel marine engine (51 inches) that produce the same power ratings.

The specially configured marine engine has been designed for easy maintenance and reduces or eliminates belts, pulleys, hoses and hose clamps on the motor relative to the supercharger, alternator, water pump and starter. The supercharger may be omitted in certain constructions. The peripheral components are geared driven either from the flywheel or from the crankshaft and are mounted on the top side of the integrated bell housing and/or transmission case for easy access. Therefore, the user need not adjust belts and pulleys to drive those engine accessories. This reduces maintenance and eliminates premature component failures. Some advantages of the integrated bell housing combined with the marine internal combustion engine configured as a GM 60 degree V6 is a compact size which fits under the floor and in the space of a typical outboard engine well. This provides more usable deck space and cockpit space for fishing, diving, docking or other marine activities. The specially configured marine engine is only 32 inches long and 24 inches wide compared with a 47 inch long and 28 inch wide which is typical of 5.7LTR rated for 300 horsepower. As shown in FIG. 1, the marine internal combustion engine with the integrated bell housing 10 has a length of 32 inches compared with a length of 47 inches for the 5.7 GM 300HP motor weighing 800 pounds and compared with 51 inch length for the diesel 315HP marine engine weighing 1100 pounds. Multiple gear ratios in the clutch controlled geared transmission with the present invention provide a wide weight range of boats and applications. The engine accessories are top mounted at positions ranging from 10 AM to 2 PM on the transmission bell housing. Since these engine accessories are driven by drive shaft extending through the bell housing and additional gear facing on the flywheel, there are no belts, pulleys, hoses or hose clamps for the supercharger, alternator, water pump and starter.

Figure 2:
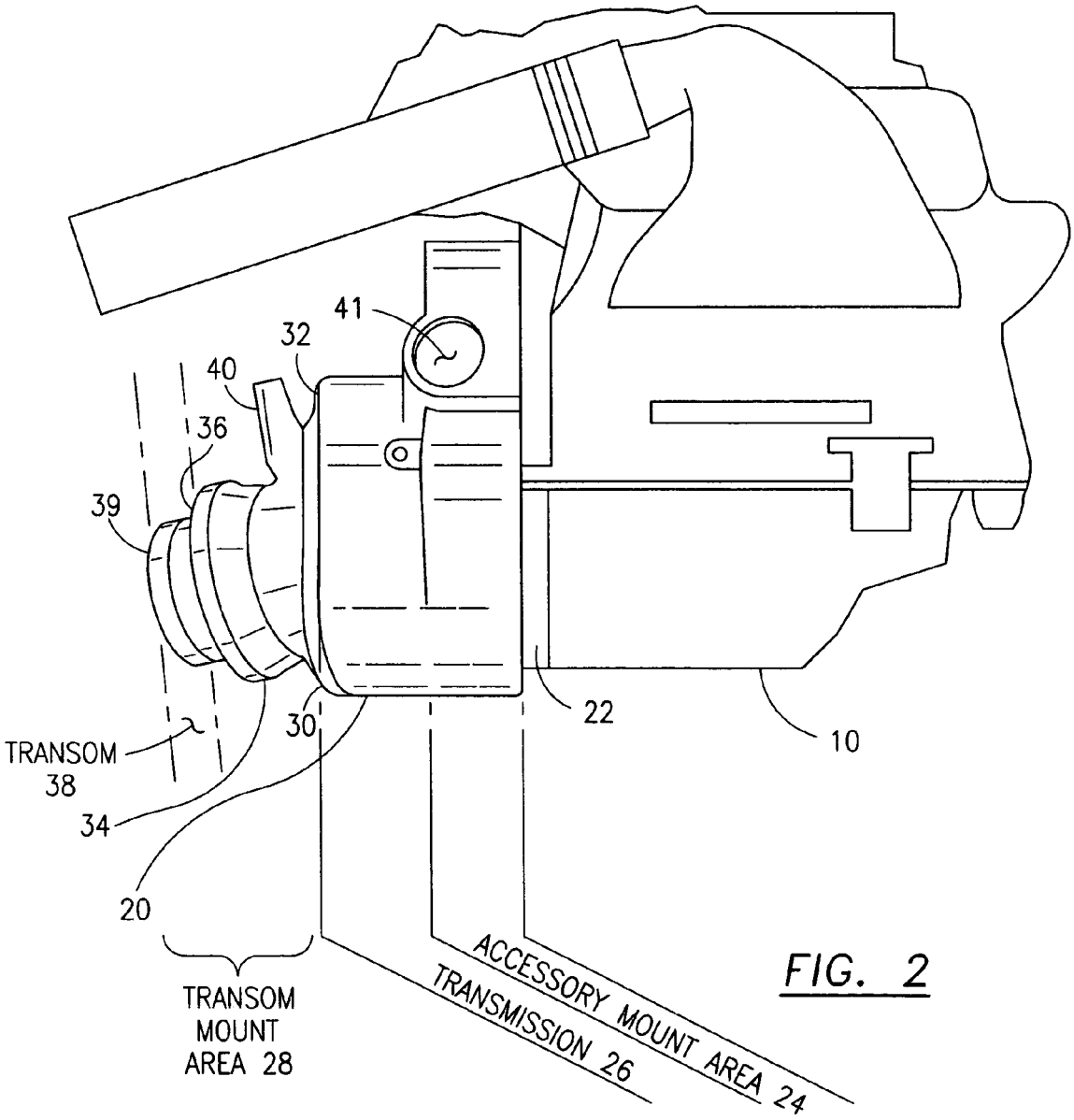
FIG. 2 diagrammatically illustrates a side elevational view of the marine engine configured with the integrated bell housing.

FIG. 2 diagrammatically illustrates a side elevational view of a specially configured marine engine 10. Marine engine 10 has an integrated bell housing 20 bolted or mounted to rear engine block 22. FIG. 2 shows several areas on integrated bell housing 20. Accessory mount area 24, transmission area 26 and transom mount area 28 are shown. Rear plate 30 is bolted to rear face 32 of bell housing 20. Water pump 40 is mounted on rear plate 30. A generally frustoconical shaped shield 34 protects a rotating propeller shaft (not shown) which protrudes from a seal (not shown) in end plate 30 in the interior of shield 34. A seal ring 36 is disposed in a ring channel on the end face of shield 34. Transom 38 is diagrammatically illustrated in FIG. 2. A generally cylindrical end piece 39 extends through transom 38. The utilization of bell housing 20, shield 34 and end piece 39 enables motor 10 to be mounted with a two (2) leg forward mount support system either on the bulk head or the stringers of the marine vessel. The two legs are attached or fixed to the fore end of marine engine 10. The rear mount design (cone 39 in transom 38) allows for two (2) mounting configurations. First, the transmission housing end piece 39 penetrates transom 38 of the marine vessel to permit the propeller shaft (not shown) to attach to a surface drive application using the transom 38 as the rear mounting surface. Examples of surface drive applications are shown in U.S. Pat. Nos. 6,482,057 and/or 5,326,294. In a second configuration, a spreader mount can be added to set the engine on a four (4) leg mount system while still having the benefit of a 3 point mount for smoothness and expanding applications for the unique motor system in other pure inboard straight shaft configurations. In a third application to adapt to conventional stem drive units. The internal transmission gears can be omitted and the capling shaft of a stem drive unit can be attached directly through a steady bearing placed in the rear face plate 32. This would also shorten the engine package approximately another 4 inches. The two front mounts are integrated into a redesign timing chain and gear cover allowing the front of the engine to seat on the two mounting legs. The single rear mount (cone or shield end piece 39 and butt end 36 and shield 34) for the marine engine and the transmission provides a self aligning smooth 3 point mount suspension system.

Accessory mount area 24 also includes a supercharger mount region 41 on bell housing 20.

Figure 3:
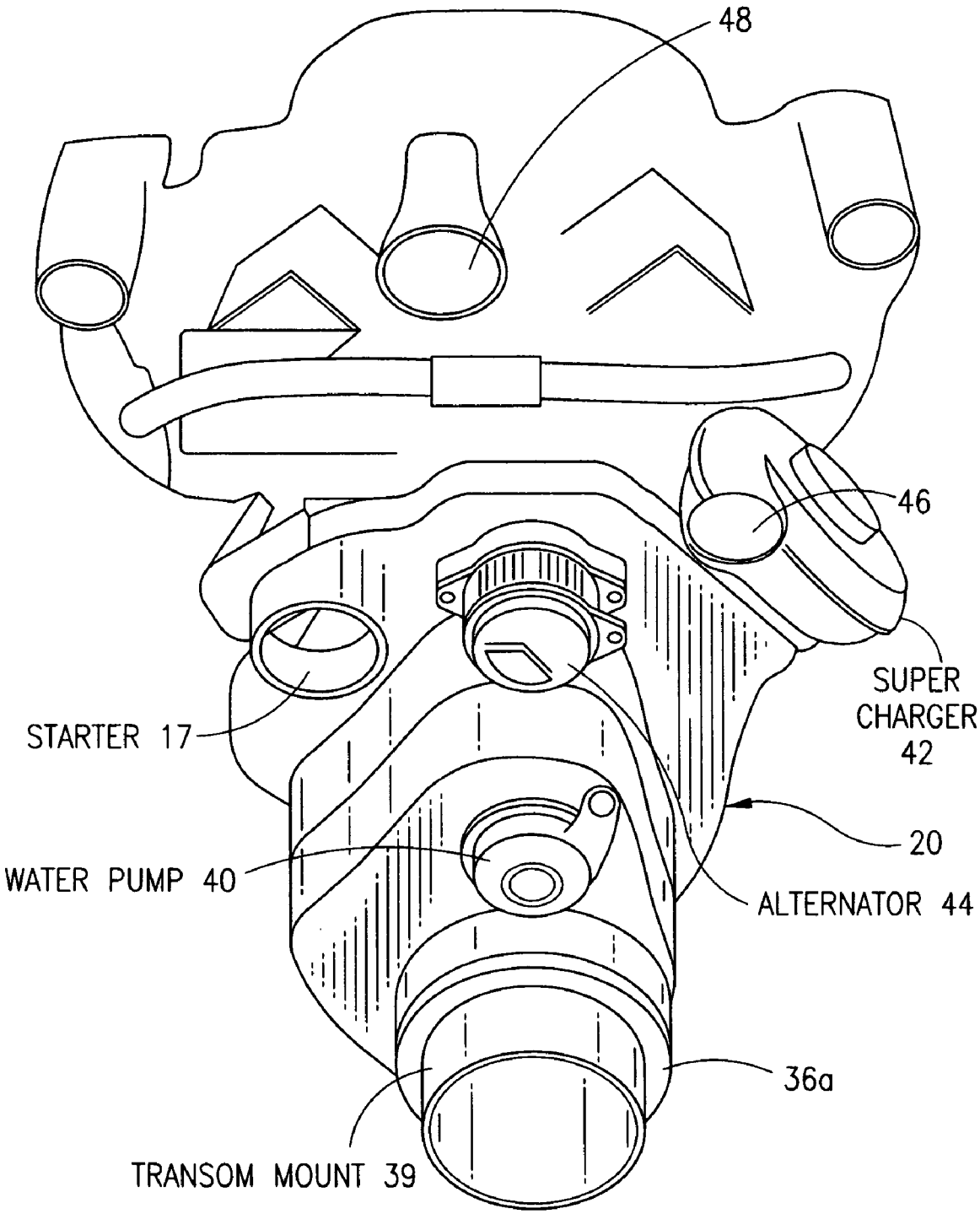
FIG. 3 diagrammatically illustrates a perspective rear view of the engine and the integrated bell housing.

FIG. 3 diagrammatically illustrates a rear view of the marine engine with the integrated bell housing 20. Similar numerals designate similar items throughout the drawings. In FIG. 3, supercharger 42 has been mounted onto bell housing 20. Alternator 44 is also mounted at 12 o'clock on the bell housing 20. A starter region 17 is provided at the 10 PM position on bell housing 20. Typically, an intercooler is connected between exhaust 46 of supercharger 42 and intake 48 of the throttle body.

The integrated transmission bell housing accommodates gear driven components of alternator, supercharger, direct drive, water pump and starter. Historically all of these components in the marine industry have been driven from the front of the engine with belts and pulleys. The present approach is to eliminate this high maintenance system by running them off the flywheel as gear driven components. Only starters have been known to be configured to be gear driven by a gear ring attached around the flywheel. The gear ring on a standard flywheel is too soft to be used to run any other continuous devices due to the high load characteristics. For this reason, the invention uses one of two methods to run the other components. (1) The preferred method is to use and manufacture a flywheel with the needed gears cut into the flywheel to run each of the needed components. (2) Alternatively, a standard flywheel may be used and additional custom gear rings attached to run the components.

Alternator: The alternator of choice is designed to run to a maximum RPM of 15,000 to 18,000 assuming the use of a 12 inch flywheel gear and 4 inch gear on the alternator. The ratio becomes 3 to 1. With a maximum engine RPM of 5200, the alternator will spin in the 15,600 RPM range. Depending on where the gear is placed, as an example, it could be 9 inches at the flywheel and 3 at the alternator, the same end result can be achieved. The alternator is placed high on the bell housing for easy access.

Supercharger: The supercharger is driven off a single shaft placed into the housing vertically and driven off a face gear on the flywheel. The same principals apply. Using a 12 inch flywheel gear and 1 inch gear on the flywheel, the system will produce a ratio of 12 to 1 at 5200 engine RPM and the supercharge impeller will spin at roughly 62,000 RPM to develop the air pressure needed to achieve horsepower goals. Another alternative to this gear ratio is to install an idler gear which would also change the rotation of the supercharger. As with the alternator, gear ratios may be achieved by varying the size of gears access. Additionally, a more efficient turbo style impeller is to used gain greater efficiencies. The uniqueness of this design is that it offers the most efficient engine performance in a very small package with very few parts making it far less susceptible to component failure seen in typical centrifugal superchargers.

Intercooler: In the 300 horsepower model or any engine using this conversion system, an intercooler is needed or preferred if the boost levels to generate the desired horsepower exceed roughly 9 pounds of boost pressure. This cooling of the air charge assures that the engine will not experience harmful detonation at a given fuel octane rating. While there are other methods to control this action such as reducing timing or raising octane, intercooling offers the greatest level of protection over a wide range of variables. To understand how this principal works, it is helpful to understand the basics of supercharger technology and why superchargers make more power. A rough starting estimate to calculate HP gain is to take boost (say 5 psi) and multiply it by 7% (a constant) to get your approximate power gain (example 35%). A rounding of 7% is used because 7% is approximately how much more air and fuel gets into the motor with each pound of boost that is added. To get a more exact figure, take 1 psi boost and divide by normal atmospheric pressure, 14.7 psi at sea level. 1 divided by 14.7 equals 6.802%. Under ideal conditions, the user can expect to burn 6.802% more fuel and air per pound of boost.

There are many ways to cool the air. In the present operating system, water is supplied from the water pump. There are also other style water coolers, mostly tube type where water runs through tubes cooling air in an enclosed chamber. A unique flat plate collector design is used because it offers more surface area for the water to cool the air in a smaller space, and offers the least amount of restriction in airflow. Less restriction equals more efficient horsepower gains.

Water Pump: The water pump is driven directly off the engine's crankshaft by a shaft that fits into a keyed slot in the end of the crankshaft connected to a centrifugal pump housing. This type of pump provides higher volume and can be run dry without pump failure.

The bell housing or transmission casing 20 is of one-piece design incorporating a rear mounting system 39 in the rear cover plate. The bell housing case 20 could be made of composite materials (such as fiberglass) internally reinforced with aluminum plates to hold bearing tolerances. Casing 20 could also be cast in aluminum.

Transmission gear sets: The transmission consists of 5 gears on 3 shafts and provides 4 different gear rations depending on gear size selections. There will be a forward set of gears, a reverse set of gears and a idler gear. Shifting between gears is achieved with a sliding clutch assembly, possibly assisted by a centrifugal designed clutch integrated with the flex plate to ease and smooth shifting.

Figure 4A:
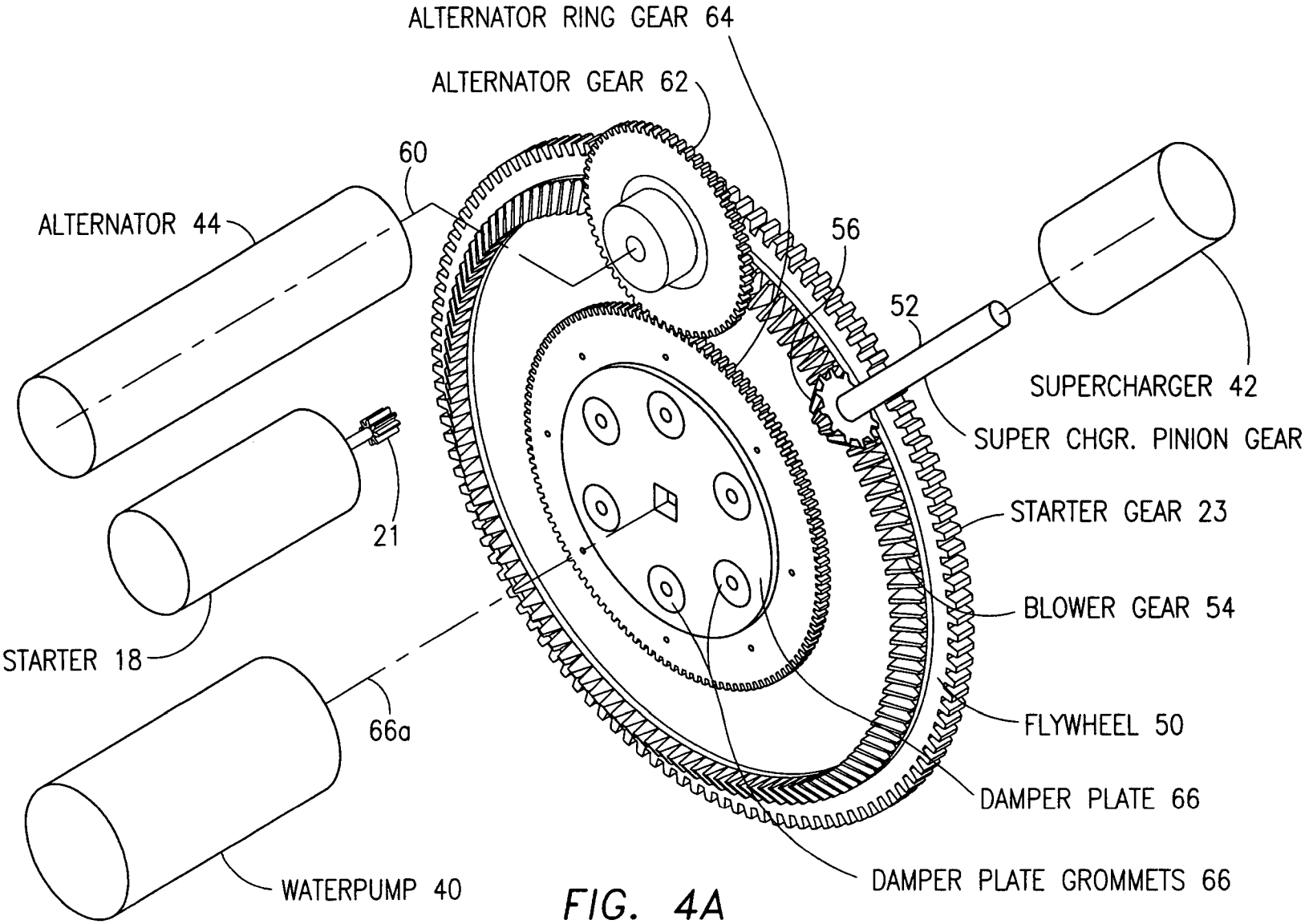
FIGS. 4A and 4B diagrammatically illustrate the integrated transmission bell housing carrying the engine accessories and the flywheel and associated connections internal to the bell housing and the crankshaft in accordance with the principles of the present invention.
Figure 4B:
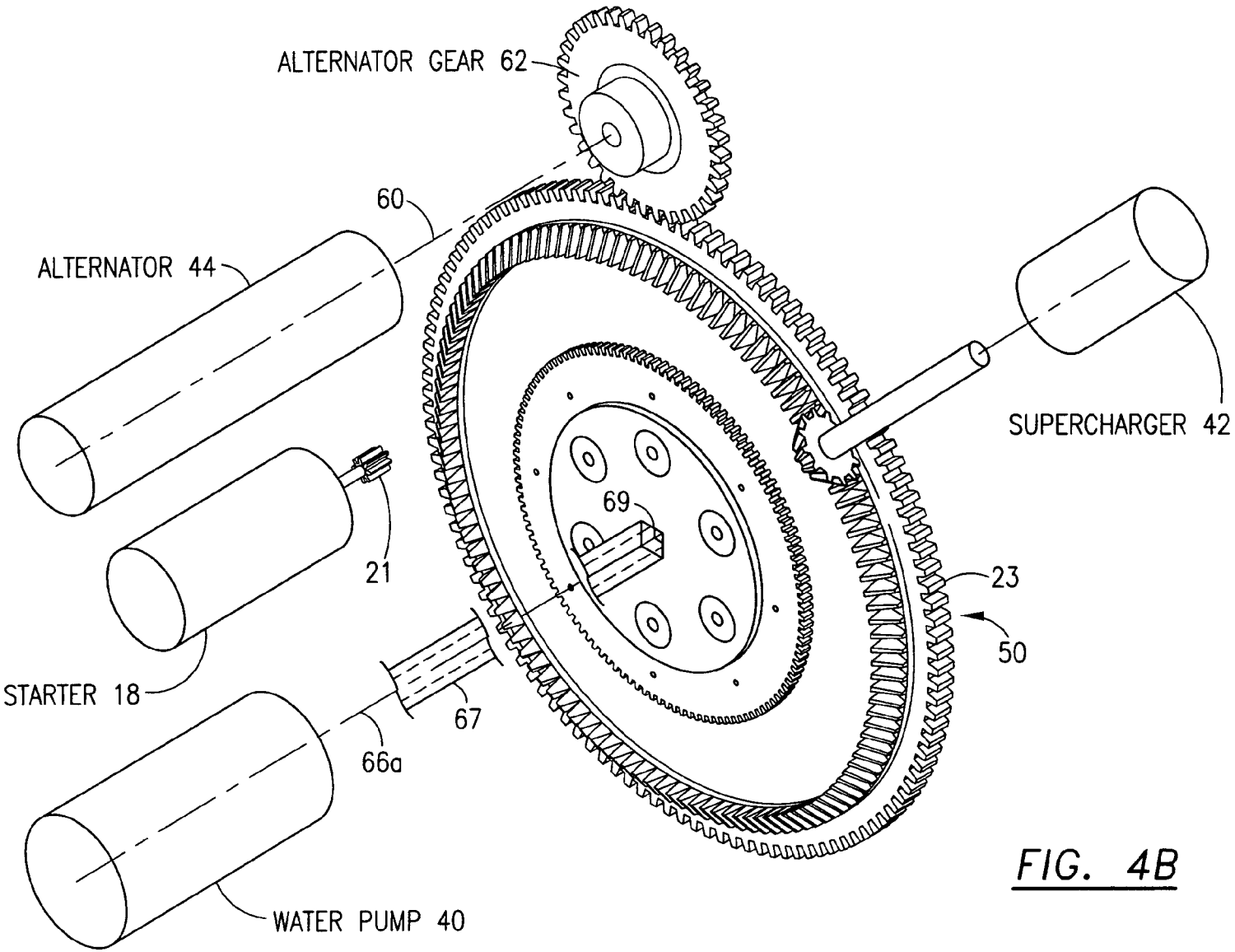

FIGS. 4A and 4B diagrammatically illustrate the positioning of the engine accessories and how those accessories are driven in both preferred embodiments of the present invention. In FIG. 4A, a flywheel 50 is rotatably mounted within integrated bell housing 20 (not shown). Flywheel 50 is coupled to the crankshaft which extends into the interior space of the bell housing. Supercharger 42, mounted at 2 AM in the present embodiment, is coupled to a supercharger drive shaft 52. The supercharger is driven by the flywheel 50 due to a face gear or blower gear 54 formed on flywheel 50. Supercharger drive shaft 52 is coupled or connected to a complementary pinion gear 56. In some instances herein, blower gear 54 is referred to as a first gear on flywheel 50 and pinion gear 56 is sometimes referred to as a first complementary gear. Other types of gear systems could be utilized. One point is that rotating flywheel 50 includes or carries a gear which drives a complementary gear on supercharger drive shaft 56. As shown in FIG. 3, supercharger 42 is mounted by an appropriate mechanism onto the exterior of bell housing 20. The mount could include bolts, flanges, support brackets or other mounting systems permitting removal of the supercharger. The same or similar mounting systems may be utilized for alternator 44, water pump 40 and starter 18. Starter 18 includes starter gear 21 which cooperates and interlocks with peripheral or starter gear 23. Alternator 44 is driven via an alternator drive shaft diagrammatically illustrated as drive shaft 60. Drive shaft 60 is coupled to an alternator gear 62. In the illustrated embodiment, alternator gear 62 is complementary to and interlocks with alternator ring gear 64 carried by damper plate 66. In this illustrated embodiment, damper plate 66 is mounted onto flywheel 50 by damper plate gromets 68. Alternator ring gear 64 is attached to damper plate 66 and, in the illustrated embodiment, damper plate 66 is mounted to flywheel 50. Therefore, the flywheel carries the second gear 64 (alternator ring gear 64) and alternator 44 is driven by a complementary gear (alternator gear 62). Water pump 40 is driven by a drive shaft diagrammatically illustrated as shaft 66*a* keyed to the crankshaft of the engine. Shafts 52, 60, 66*a* and the drive shaft for starter 18 are rotatably mounted through the bell housing. The shafts are sealingly and rotatably mounted such that oil, which typically floods the interior of integrated bell housing 20, lubricates the flywheel and the aforementioned components within the bell housing.

FIG. 4B diagrammatically illustrates an alternative embodiment wherein alternator 44, although mounted at the 12 o'clock position on the integrated bell housing 20, is driven by peripheral gear 23 on flywheel 50. In this sense, complementary alternator gear 62 is complementary to peripheral gear 23. Also, FIG. 4B diagrammatically shows that water pump drive shaft 66*a* may rotate in a hollow shaft 67 running through aperture 69 of flywheel 50. Typically, blower gear 54 is identified as a face gear. Complementary gear 56 is typically identified as a pinion gear. In the event supercharger 42 is not utilized, the system with the integrated bell housing will include an alternator 44, driven from flywheel 50, and water pump 40 driven from a water drive shaft keyed to the crankshaft of the engine.

Figure 5:
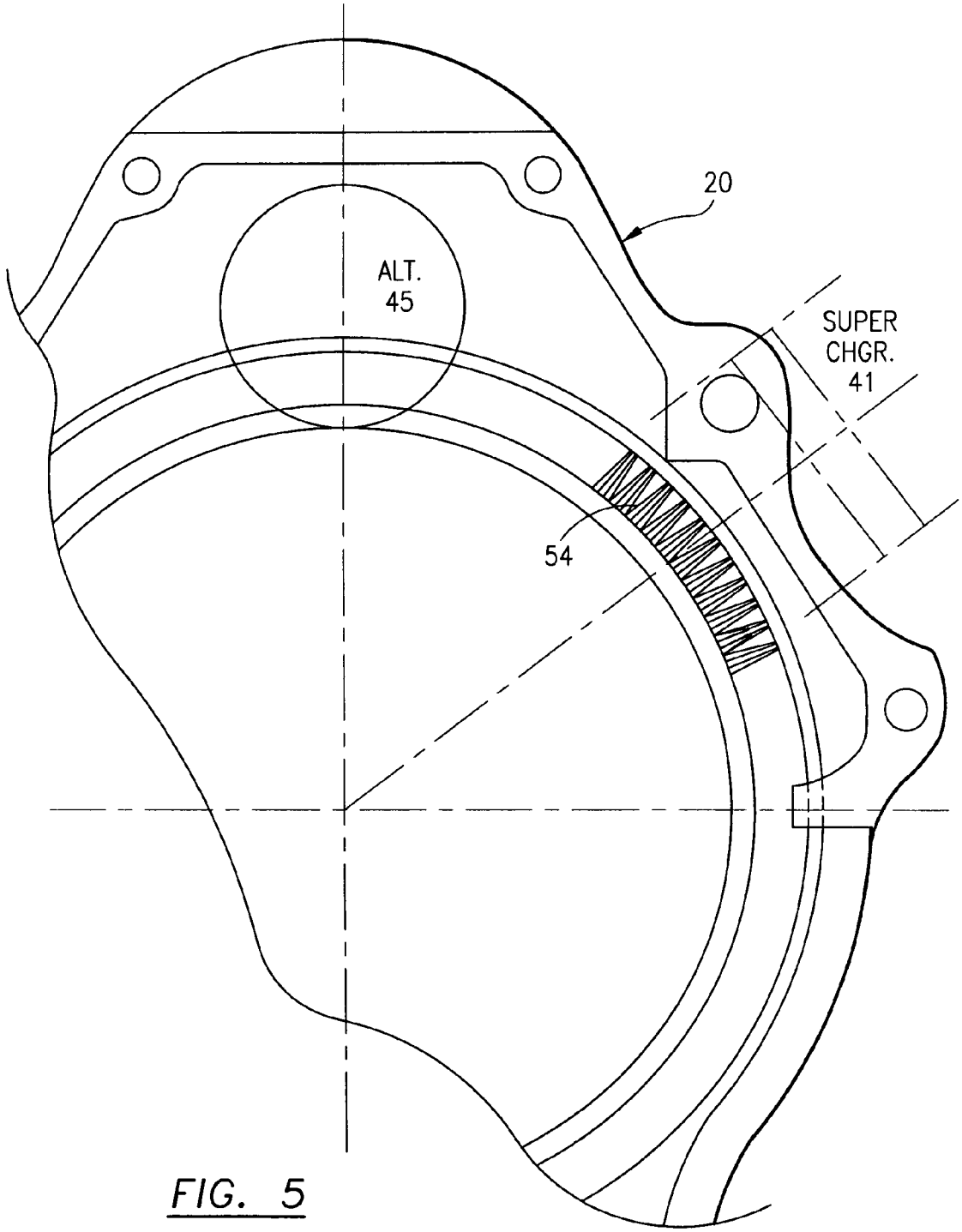
FIG. 5 diagrammatically illustrates a schematic end view of a portion of the integrated bell housing showing the location of the alternator and supercharger on the housing.

FIG. 5 diagrammatically illustrates an end view of a portion of bell housing 20. Alternator region 45 and supercharger region 41 and face gears 54 for supercharger 42 are shown.

Figure 6:
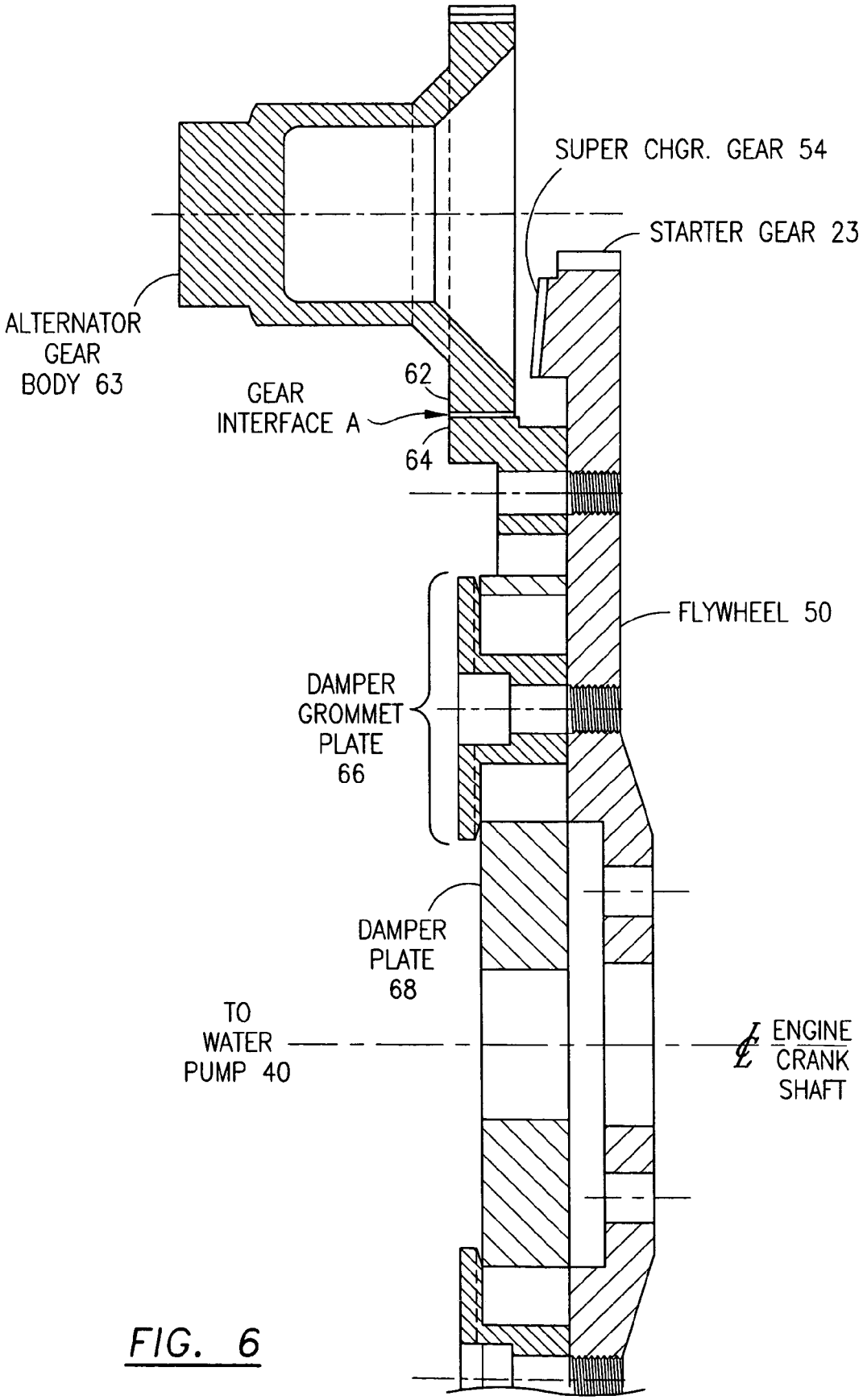
FIG. 6 diagrammatically illustrates the flywheel, damper plate and alternator in accordance with one embodiment of the present invention.

FIG. 6 diagrammatically illustrates one configuration of the flywheel and the alternator as diagrammatically illustrated in FIG. 4A. Flywheel 50 has attached thereto damper plate 68 via damper gromet plate 66. Alternator ring gear 64 is shown at gear interface A along with alternator gear 62. Alternator gear 62 is formed on alternator gear body 63. Supercharger gear 54 is shown as a face gear on flywheel 50. Starter gear 23 (sometimes called a peripheral gear 23) is shown protruding from a periphery of flywheel 50.

Figures 7A, 7B:
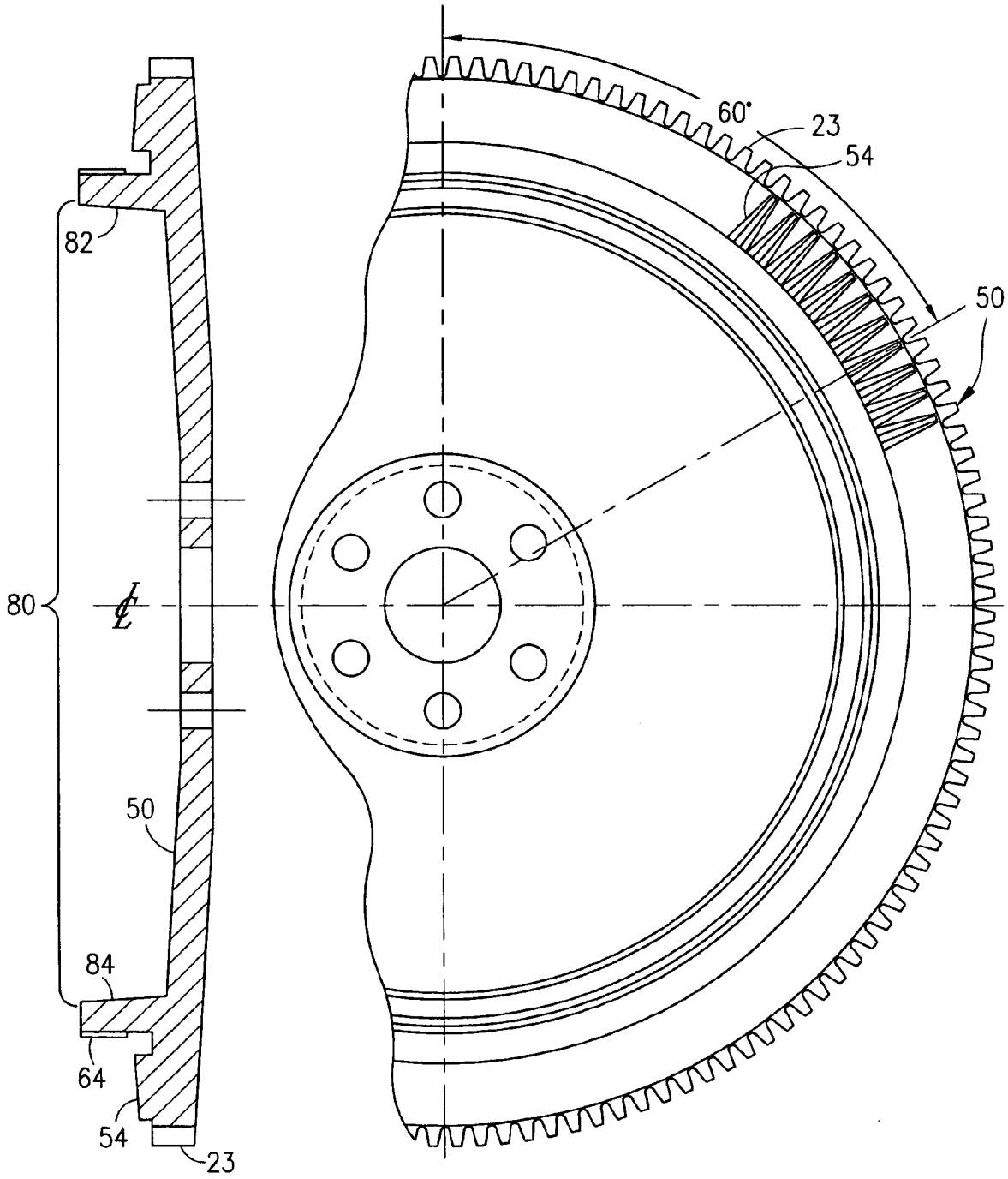
FIGS. 7A and 7B diagrammatically illustrate a portion of the flywheel in a partial rear view (FIG. 7A) and a cross sectional view (FIG. 7B)

FIG. 7A diagrammatically shows a partial view of flywheel 50. FIG. 7B shows a cross-sectional view of flywheel 50 wherein damper plate 68 (not shown) slides into and locks into region 80 of flywheel 50. FIG. 7A diagrammatically shows several but not all of supercharger gear 54 and shows many teeth of the starter gear 23. FIG. 7B shows alternator ring gear 64. Damper 68 can be configured to be movably mounted with respect to flywheel 50 and may slide into and out of region 80. Walls 82, 84 of flywheel 50 are sloped radially outward to accommodate a movable damper. The movable damper has a similar slope wall along its periphery and may include spring loaded pins protruding therefrom which are initially biased inwards but which move outward to lock onto walls 82, 84 based upon the centrifugal force caused by the rotating damper plate. When the damper is movably mounted with respect to flywheel 50, the alternator 44 should be driven by peripheral gear 23 on flywheel 50 as shown in FIG. 4B.

Figure 8:
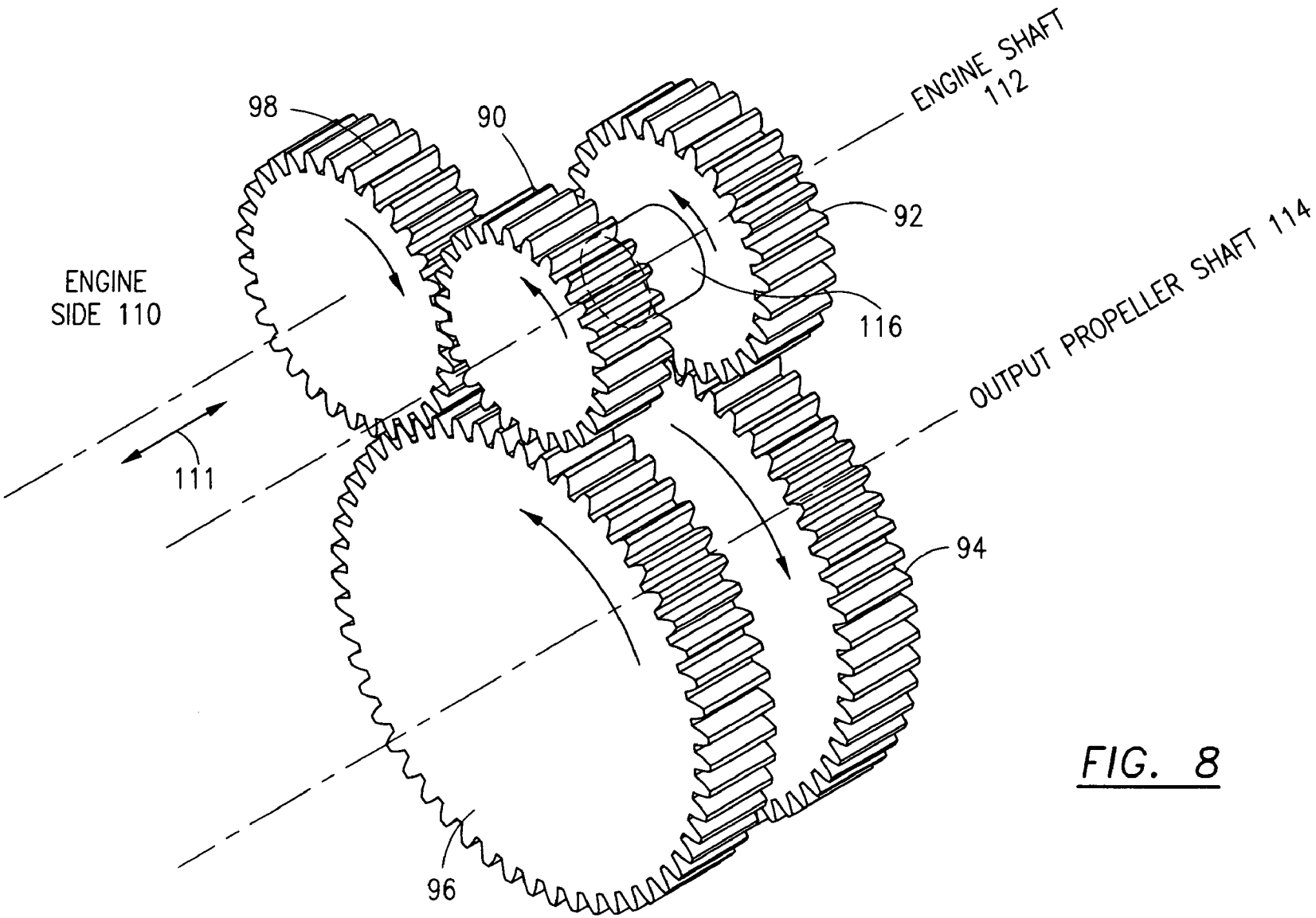
FIG. 8 diagrammatically illustrates the mechanical clutch controlled, geared transmission utilized in conjunction with the marine engine and the integrated bell housing.
Figure 9:
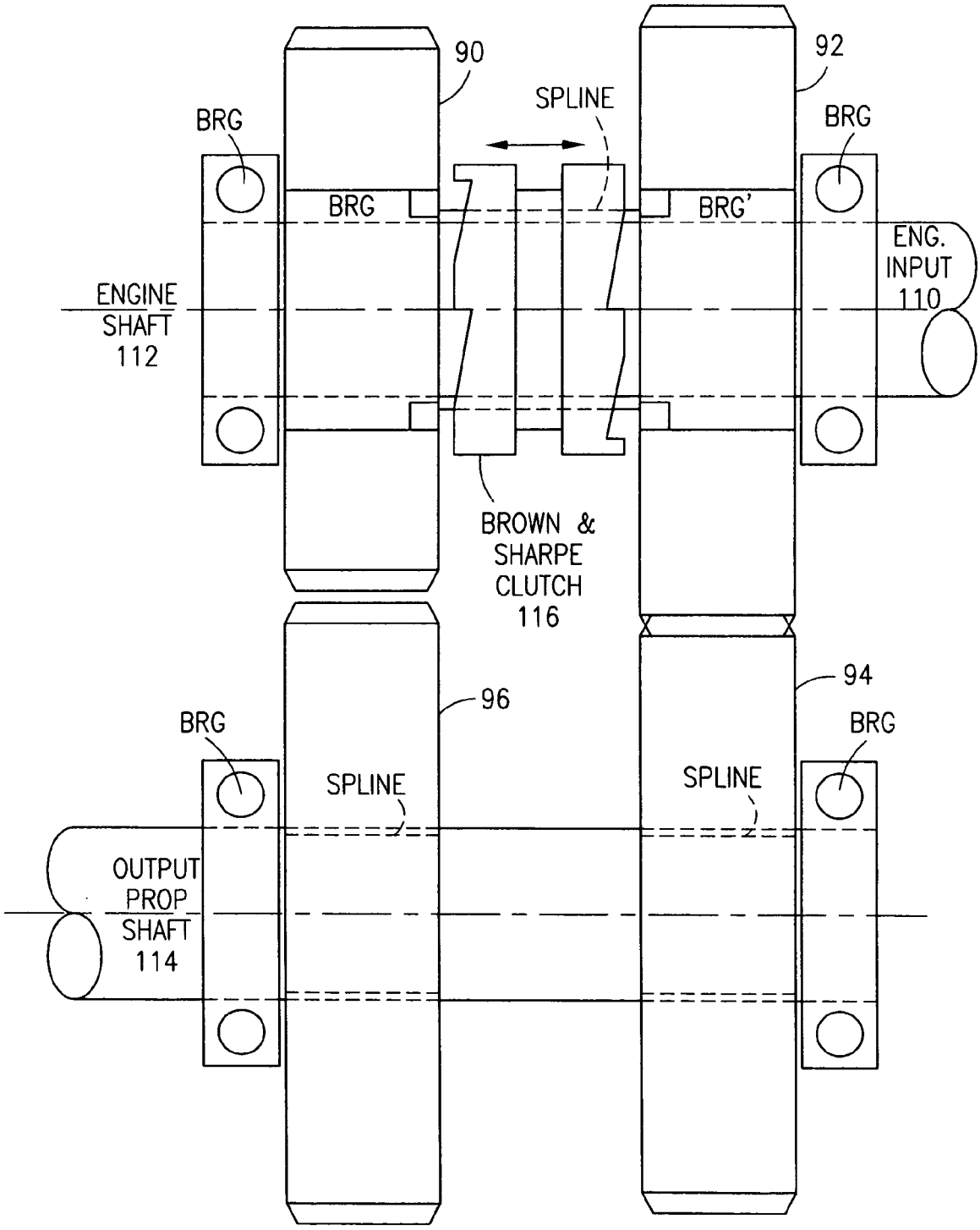
FIG. 9 diagrammatically illustrates the clutch controlled geared transmission; and, FIGS. 10A, 10B and 10C diagrammatically illustrate a configuration of the clutch controlled geared transmission (FIG. 10A), the gears on the engine side (FIG. 110B) and the gears on the output side (FIG. 10C).

FIG. 8 diagrammatically illustrates the clutch controlled mechanical gear transmission which is located in the interior of integrated bell housing 20 generally in transmission region 26 shown in FIG. 2. To orient gears 90, 92, 94, 96 and 98, FIG. 8 diagrammatically illustrates engine side 110 as well as engine shaft 112 and output propeller shaft 114. Gear 90 is controllably coupled to gear 92 with dog clutch 116. Clutch 116 is a common clutch which utilizes parts sliding on a spline shaft. Gears 90, 92 are mounted on bearings on a shaft which are free running. Idler gear 98 is free running on a shaft and moves controllably in the direction shown by double headed arrow 111. Based upon the position of a control system designating forward and reverse positions, output gears 94, 96 are activated thereby rotatably moving output propeller 114 either in a clockwise direction (gear 94) or a counterclockwise direction (gear 96). FIG. 9 diagrammatically shows gears 90, 92, 94 and 96 mounted on engine shaft 112 (gears 90, 92) and output propeller shaft 114 (gears 94, 96). Gears 92 and 94 are engaged whereas gears 90, 96 are not engaged. The clutch 116 utilized in the present working embodiment is a Brown and Sharp clutch, commonly available in the engine component industry.

Figures 10A, 10B, 10C:
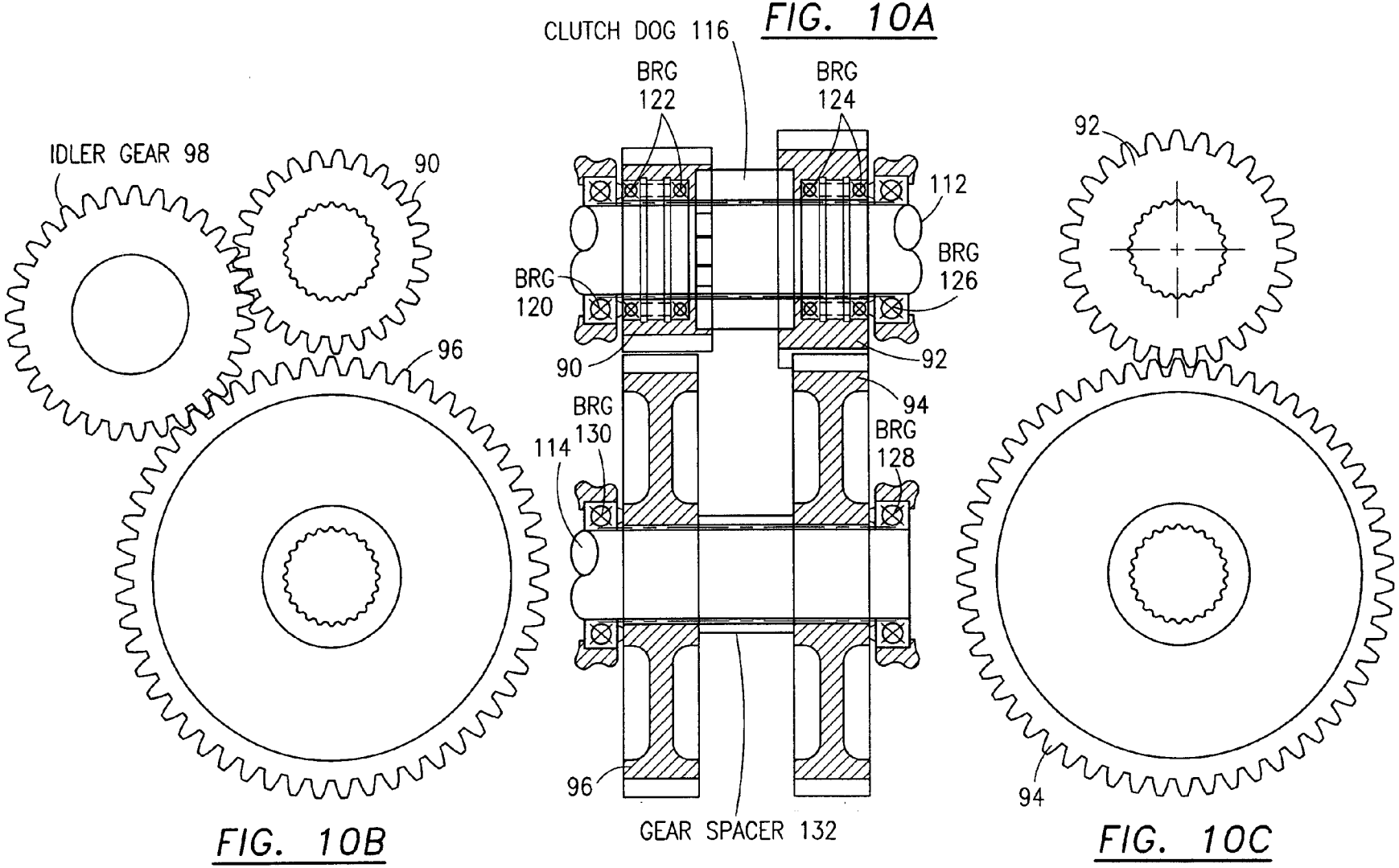

FIGS. 10A, 10B and 10C diagrammatically illustrate the clutch controlled geared transmission. Gear 90 is rotatably mounted with bearing 120 and bearing set 122 and gear 92 is rotatably mounted with bearing 126 and bearing set 124. Gear 94 is rotatably mounted with respect to the casing with bearing 128. Gear 96 is rotatably mounted with respect with the casing with bearing 130. Shaft 114 is shown carrying gears 94, 96. Gear spacer 132 maintains the spacing between gears 94, 96. Clutch dog 116 is also illustrated in FIG. 10A. Idler gear 98 (FIG. 10B) is not illustrated in FIG. 10A because the gear is disposed behind bearing assembly 120, 122, 124, 126 and clutch 116.

It should be noted with respect to the engine accessories mounted on the integrated transmission bell housing, other possible engine accessories can be mounted on the bell housing with power take offs from the oil lubricated case. The gears discussed herein, including the gear on the flywheel, may be nitrided gears or carbon hardened gears. The bell housing referred to herein sometimes includes the transmission case.

The claims appended hereto are meant to cover modifications and changes within the scope and the spirit of the present invention.

What is claimed is:

1. An integrated bell housing for a marine internal combustion engine, the bell housing carrying on its exterior one or more engine accessories from the group of engine accessories consisting of a supercharger, an alternator and a water pump, the marine engine having a crank shaft extending into an interior space of the bell housing and coupled to a flywheel, the bell housing enclosing a geared transmission which is coupled to said crank shaft, the integrated bell housing comprising:

means for mounting said supercharger onto said exterior of said bell housing;

said fly wheel having first gear thereon and carrying a second gear;

a first complementary gear, cooperating with said first gear, said first complementary gear coupled to a supercharger drive shaft rotatably mounted through said bell housing such that said fly wheel drives said supercharger;

means for mounting said water pump onto said exterior of said bell housing;

a water pump drive shaft keyed to said crank shaft and rotatably mounted through said bell housing such that said crank shaft drives said water pump;

means for mounting said alternator onto said exterior of said bell housing; and a second complementary gear, cooperating with said second gear, said second complementary gear coupled to an alternator drive shaft rotatably mounted through said bell housing such that said fly wheel drives said alternator.

2. An integrated bell housing for a marine engine as claimed in claim 1 wherein said first gear is a face gear on said fly wheel and said first complementary gear is a pinion gear.

3. An integrated bell housing for a marine engine as claimed in claim 1 wherein said fly wheel includes a damper plate, said damper plate having said second gear thereon and said second complementary gear being driven by the damper plate attached to said fly wheel.

4. An integrated bell housing for a marine engine as claimed in claim 1 wherein said second complementary gear is a peripheral gear on an edge of said flywheel.

5. An integrated bell housing for a marine engine as claimed in claim 1 wherein said supercharger drive shaft and said water pump drive shaft and said alternator drive shaft are sealingly and rotatably mounted through said bell housing.

6. An integrated bell housing for a marine engine as claimed in claim 2 wherein said fly wheel includes a damper plate, said damper plate having said second gear thereon and said second complementary gear being driven by the damper plate attached to said fly wheel.

7. An integrated bell housing for a marine engine as claimed in claim 2 wherein said second complementary gear is a peripheral gear on an edge of said flywheel.

8. An integrated bell housing for a marine engine as claimed in claim 6 wherein said supercharger drive shaft and said water pump drive shaft and said alternator drive shaft are sealingly and rotatably mounted through said bell housing.

9. An integrated bell housing for a marine engine as claimed in claim 7 wherein said supercharger drive shaft and said water pump drive shaft and said alternator drive shaft are sealingly and rotatably mounted through said bell housing.

10. An integrated bell housing for a marine internal combustion engine, the bell housing carrying on its exterior an alternator and a water pump, the marine engine having a crank shaft extending into an interior space of the bell housing and coupled to a flywheel, the bell housing enclosing a geared transmission which is coupled to said crank shaft, the integrated bell housing comprising:

said fly wheel carrying an accessory gear;

means for mounting said water pump onto said exterior of said bell housing;

a water pump drive shaft keyed to said crank shaft and rotatably mounted through said bell housing such that said crank shaft drives said water pump;

means for mounting said alternator onto said exterior of said bell housing; and a complementary accessory gear, cooperating with said accessory gear, said complementary accessory gear coupled to an alternator drive shaft rotatably mounted through said bell housing such that said fly wheel drives said alternator.

11. An integrated bell housing for a marine engine as claimed in claim 10 wherein said fly wheel includes a damper plate, said damper plate having said accessory gear thereon and said complementary accessory gear being driven by the damper plate attached to said fly wheel.

12. An integrated bell housing for a marine engine as claimed in claim 10 wherein said complementary accessory gear is a peripheral gear on an edge of said flywheel.

13. An integrated bell housing for a marine engine as claimed in claim 11 wherein said water pump drive shaft and said alternator drive shaft are sealingly and rotatably mounted through said bell housing.

14. An integrated bell housing for a marine engine as claimed in claim 12 wherein said water pump drive shaft and said alternator drive shaft are sealingly and rotatably mounted through said bell housing.

15. An integrated bell housing for a marine internal combustion engine, the bell housing carrying on its exterior a supercharger, an alternator and a water pump, the marine engine having a crank shaft extending into an interior space of the bell housing and coupled to a flywheel, the bell housing enclosing a geared transmission which is coupled to said crank shaft, the integrated bell housing comprising:

means for mounting said supercharger onto said exterior of said bell housing;

said fly wheel having first gear thereon and carrying a second gear;

a first complementary gear, cooperating with said first gear, said first complementary gear coupled to a supercharger drive shaft rotatably mounted through said bell housing such that said fly wheel drives said supercharger;

means for mounting said water pump onto said exterior of said bell housing;

a water pump drive shaft keyed to said crank shaft and rotatably mounted through said bell housing such that said crank shaft drives said water pump;

means for mounting said alternator onto said exterior of said bell housing; and a second complementary gear, cooperating with said second gear, said second complementary gear coupled to an alternator drive shaft rotatably mounted through said bell housing such that said fly wheel drives said alternator.

16. An integrated bell housing for a marine engine as claimed in claim 15 wherein said first gear is a face gear on said fly wheel and said first complementary gear is a pinion gear.

17. An integrated bell housing for a marine engine as claimed in claim 15 wherein said fly wheel includes a damper plate, said damper plate having said second gear thereon and said second complementary gear being driven by the damper plate attached to said fly wheel.

18. An integrated bell housing for a marine engine as claimed in claim 15 wherein said second complementary gear is a peripheral gear on an edge of said flywheel.

19. An integrated bell housing for a marine engine as claimed in claim 15 wherein said supercharger drive shaft and said water pump drive shaft and said alternator drive shaft are sealingly and rotatably mounted through said bell housing.

20. An integrated bell housing for a marine engine as claimed in claim 16 wherein said fly wheel includes a damper plate, said damper plate having said second gear thereon and said second complementary gear being driven by the damper plate attached to said fly wheel.

21. An integrated bell housing for a marine engine as claimed in claim 16 wherein said second complementary gear is a peripheral gear on an edge of said flywheel.

22. An integrated bell housing for a marine engine as claimed in claim 20 wherein said supercharger drive shaft and said water pump drive shaft and said alternator drive shaft are sealingly and rotatably mounted through said bell housing.

23. An integrated bell housing for a marine engine as claimed in claim 21 wherein said supercharger drive shaft and said water pump drive shaft and said alternator drive shaft are sealingly and rotatably mounted through said bell housing.

24. An integrated bell housing for a marine internal combustion engine, the bell housing carrying on its exterior one or more engine accessories from the group of engine accessories consisting of a supercharger, an alternator and a water pump, the marine engine having a crank shaft extending into an interior space of the bell housing and coupled to a flywheel, the integrated bell housing comprising:

means for mounting said supercharger onto said exterior of said bell housing;

said fly wheel having first gear thereon and carrying a second gear;

a first complementary gear, cooperating with said first gear, said first complementary gear coupled to a supercharger drive shaft rotatably mounted through said bell housing such that said fly wheel drives said supercharger;

means for mounting said water pump onto said exterior of said bell housing;

a water pump drive shaft keyed to said crank shaft and rotatably mounted through said bell housing such that said crank shaft drives said water pump;

means for mounting said alternator onto said exterior of said bell housing; and a second complementary gear, cooperating with said second gear, said second complementary gear coupled to an alternator drive shaft rotatably mounted through said bell housing such that said fly wheel drives said alternator.

25. An integrated bell housing for a marine engine as claimed in claim 24 wherein said first gear is a face gear on said fly wheel and said first complementary gear is a pinion gear.

26. An integrated bell housing for a marine engine as claimed in claim 24 wherein said fly wheel includes a damper plate, said damper plate having said second gear thereon and said second complementary gear being driven by the damper plate attached to said fly wheel.

27. An integrated bell housing for a marine engine as claimed in claim 24 wherein said second complementary gear is a peripheral gear on an edge of said flywheel.

28. An integrated bell housing for a marine engine as claimed in claim 25 wherein said fly wheel includes a damper plate, said damper plate having said second gear thereon and said second complementary gear being driven by the damper plate attached to said fly wheel.

29. An integrated bell housing for a marine engine as claimed in claim 25 wherein said second complementary gear is a peripheral gear on an edge of said flywheel.

30. An integrated bell housing for a marine internal combustion engine, the bell housing carrying on its exterior an alternator and a water pump, the marine engine having a crank shaft extending into an interior space of the bell housing and coupled to a flywheel, the integrated bell housing comprising:

said fly wheel carrying an accessory gear;

means for mounting said water pump onto said exterior of said bell housing;

a water pump drive shaft keyed to said crank shaft and rotatably mounted through said bell housing such that said crank shaft drives said water pump;

means for mounting said alternator onto said exterior of said bell housing; and a complementary accessory gear, cooperating with said accessory gear, said complementary accessory gear coupled to an alternator drive shaft rotatably mounted through said bell housing such that said fly wheel drives said alternator.

31. An integrated bell housing for a marine engine as claimed in claim 30 wherein said fly wheel includes a damper plate, said damper plate having said accessory gear thereon and said complementary accessory gear being driven by the damper plate attached to said fly wheel.

32. An integrated bell housing for a marine engine as claimed in claim 30 wherein said complementary accessory gear is a peripheral gear on an edge of said flywheel.

* * * * *